US005096319A

United States Patent [19]

Gueret

[11] Patent Number: 5,096,319

[45] Date of Patent: Mar. 17, 1992

[54] APPLICATOR SET FOR EYELASH MAKEUP, INCLUDING A CAKE OF MASCARA AND A MOISTENED DISTRIBUTOR ELEMENT

[75] Inventor: Jean-Louis Gueret, Paris, France

[73] Assignee: L'Oreal, Paris, France

[21] Appl. No.: 591,060

[22] Filed: Oct. 1, 1990

Related U.S. Application Data

[63] Continuation of Ser. No. 373,493, Jun. 30, 1989, Pat. No. 5,002,415.

[30] Foreign Application Priority Data

Jun. 30, 1988 [FR] France ..... 88 08814

[51] Int. Cl.[5] ..... A46B 11/00; A45D 40/00; A45D 40/20

[52] U.S. Cl. ..... 401/126; 401/129; 401/130

[58] Field of Search ..... 401/130, 129, 123, 124, 401/125, 119, 118, 153, 126; 132/293, 313, 317, 318

[56] References Cited

U.S. PATENT DOCUMENTS

| | | | |
|---|---|---|---|
| 727,785 | 5/1903 | Gordon | 401/125 |
| 1,166,896 | 1/1916 | Garvey | 401/283 X |
| 2,046,620 | 7/1936 | Gaimari et al. | 401/153 |
| 2,148,736 | 2/1939 | Engel, Jr. | 401/129 |
| 2,990,834 | 7/1961 | Amen | 132/317 X |
| 3,215,171 | 11/1965 | Mitchell | 401/119 X |
| 3,386,792 | 6/1968 | Ireland | 401/123 X |
| 4,043,681 | 8/1977 | Funahashi | 401/153 X |
| 4,789,261 | 12/1988 | Iwase et al. | 401/283 X |
| 4,828,419 | 5/1989 | Porter et al. | 401/126 |
| 5,002,415 | 3/1991 | Gueret | 401/126 |

FOREIGN PATENT DOCUMENTS

| | | | |
|---|---|---|---|
| 0163323 | 1/1985 | European Pat. Off. . | |
| 0237487 | 9/1987 | European Pat. Off. . | |
| 0248345 | 12/1987 | European Pat. Off. . | |
| 0263329 | 4/1988 | European Pat. Off. . | |
| 2290863 | 5/1974 | France | 401/129 |
| 151630 | 12/1921 | United Kingdom | 401/119 |

*Primary Examiner*—Steven A. Bratlie
*Attorney, Agent, or Firm*—Cushman, Darby & Cushman

[57] ABSTRACT

An applicator set is proposed in the form of a fountain pen, including a solid cake of mascara and a distributor element (brush or pen). This set includes a tubular body (1) and a cap (2) carrying the distributor element (3) at the end of a rod (31); the tubular body (1) contains a cake of mascara (7) hollowed out at least partially to permit filling of the distributor element (3), and the applicator set also includes a reservoir that contains a liquid serving to moisten the distributor element (3). The reservoir (4) and the distributor element (3) are associated in such a manner that at the moment of use, this element (3) is moistened by the liquid.

8 Claims, 3 Drawing Sheets

APPLICATOR SET FOR EYELASH MAKEUP, INCLUDING A CAKE OF MASCARA AND A MOISTENED DISTRIBUTOR ELEMENT

This is a continuation of application Ser. No. 07/373,493, filed Jun. 30, 1989, now U.S. Pat. No. 5,002,415.

FIELD OF THE INVENTION

The present invention relates to an applicator set for making up the eyelashes, including a cake of mascara and a distribution element.

BACKGROUND OF THE INVENTION

The applicator sets used most often are in the form of a fountain pen; they include a reservoir containing mascara made in liquid or paste form and a removable cap for closing the reservoir, comprising a sleeve or handle for a brush carried at the end of a rod joined to the cap. In the closed position of the applicator set, the rod and brush plunge into the reservoir. When the rod is withdrawn from the reservoir, a certain quantity of mascara is picked up on the brush and can be applied to the eyelashes. Moreover, the brush generally penetrates to the interior of the reservoir via a substantially circular opening bordered by a flexible lip, the role of which is to exert a wringing or squeegee action on the bristles of the brush and eliminate the excess makeup product picked up by the brush from the inside of the reservoir. In these applicators, the quantity of mascara picked up with the aid of a brush is always approximately the same, and the user cannot vary quantity to suit the user.

Applicator sets for eyelash makeup are also known including mascara in the form of a cake, or in other words in solid form, and a brush disposed in a case. To pick up the mascara, the user moistens the brush or possibly the cake with the aid of a liquid from a source outside the set, most often saliva, and rubs the brush over the cake of mascara to pick up more or less mascara as needed. The user is thus able to vary the amount of product on the brush arbitrarily, which is advantageous for eyelash makeup, especially because the eyelashes can be coated without clumping together. However, it is disagreeable for the user to put saliva on the brush or onto the cake of mascara, or to find some outside source of liquid. Moreover, the brushes used are typically flat brushes planted with tufts of bristles, which eventually become clogged, and with which the eyelashes cannot be curled by a flick of the wrist, as can be done with cylindrical brushes in applicator sets containing a reservoir of liquid mascara. Moreover, the bulk of the case, which is generally rectangular in shape, is a handicap when it is carried in the user's handbag.

SUMMARY OF THE INVENTION

The object of the present invention is to propose a mascara applicator set including a cake of solid mascara and a distributor element that is moistened at the moment of use, the applicator set making it possible to pick up variable quantities of mascara as needed by the user, and being in the form of a fountain pen and hence not being very bulky.

The present invention proposes a cosmetic applicator set including a cake of cosmetic and a distributor element, the set being in the form of a fountain pen that includes two portions, a tubular body and a cap that comes to be affixed to the tubular body; one of the portions contains a cake of cosmetic and the other carries a distributor element that can be moistened. According to the invention, the tubular body contains a cake of solid mascara at least partially hollowed out by a cavity of conical or cylindrical form penetrated by the distributor element for filling, and the set also includes a reservoir that contains a liquid serving to moisten the distributor element. The reservoir and the distributor element are associated in such a way that at the instant of use, this element is moistened by this liquid.

Hence the subject of the present invention is a mascara applicator set including a mascara receptacle and a distributor element in the form of a founation pen that includes a tubular body on which a cap comes to be fixed; the tubular body encloses the mascara and the distributor element is fixed to the cap via a rod. The set is characterized in that the tubular body contains a cake of solid mascara at least partially hollowed out to permit filling of the distributor element, and the applicator set further includes a reservoir that contain a liquid intended to moisten the distributor element, the reservoir in the distributor element being associated in such manner that at the instant of use, this element can be moistened by this liquid.

It is provided that the mascara cake and the distributor element are disposed in such a manner that the moistened element can be rubbed over the cake of mascara several times in order to arbitrarily adjust the filling of the distributor element with makeup product.

The cake of mascara is poured while hot and is solidified by chilling. In addition to the wax and the colorants typically used, the mascara formula may include microcapsules, the walls of which are resistant to the pouring temperature of the mascara and protect cosmetically active agents as reinforcements, moistening agents, lubricants, glossing agents and coating agents. The microcapsules explode when the distributor element contacts the surface of the solidified cake, releasing the cosmetically active agents that they contain. Moreover, in certain cases, the broken microcapsules can help to lossen up the cake even without using a new, separate agent.

The reservoir contains a liquid agent, such as water or physiological serum, for loosening the product comprising the cake of mascara. This agent may optionally be mixed with at least one cosmetically active agent such as a reinforcer, embellisher, coater, lubricant, glosser or catalyst for the action of agents contained in the microcapsules of the cake. The liquid contained in the reservoir is preferably slightly gelatinized by a gelatinizing agent, such as carboxymethylcellulose, for example, to prevent its flowing too freely outside the reservoir.

The reservoir may contain at least one bead to agitate the liqiud.

In a first variant, the distributor element is a brush of the bottle-brush type, of right circular cross section. An oval, flat, rounded brush may also be used, which has the advantage of permitting better contact with the cake of mascara when the brush is twisted inside the cavity. The brush may comprise bristles provided with grooves, known as capillary bristles; such bristles are for instance described in French Patent Application No. 88 01690, filed on Feb. 12, 1988. These bristles have the advantage of making it possible to conserve the water or liquid containing the active ingredients, even after wringing out with a squeegee lip.

In another variant, the distributor element may be a flexible, tapered element or "pen", of conical or cylindroconical shape, having a flocked surface.

In yet another variant, the distributor element may be an element of spongy thermoplastic form with open pores, or may even be of felt.

In a first embodiment of the invention, the cap contains the reservoir of liquid, and the tubular body contains the mascara cake, the reservoir and the distributor element being associated with the aid of a wetting device controlled from outside the applicator making it possible to distribute on demand the desired quantity of liquid onto the distributor element, the distributor element being held, when the applicator is in the closed position, at least partly inside the mascara cake. In a second embodiment of the invention, the tubular body contains both the mascara cake and the liquid reservoir, the reservoir and the distributor element being associated in such a manner that the distributor element plunges into the liquid reservoir when the cap is joined to the tubular body.

In a first embodiment, the wetting device may comprise a pump, in particular a metering micropump, with the aspiration conduit of the pump connected to the reservoir. The reservoir may be made of rigid material and may be installed translatably in the applicator cap; in that case, in a first variant, the cap is open at its end remote the tubular body, with one of the ends of the reservoir projecting outside the cap, and the pump is actuated by pressure on the portion of the reservoir that projects outside the cap; in a second variant, the cap may also be closed at its end remote from the tubular body and may include a bellows of flexible material, such that by pressing on the end of the cap, the bellows can be compressed to a variable extent, and consequently the reservoir can be displaced in translation to actuate the pump. The pump is preferably associated with a device that can block it while the applicator set is being carried from place to place. This device is for example a lid that is adapted to the cap and covers either the part of the reservoir projecting outside the cap or the bellows of flexible material. The rod carrying the distributor element is connected to the delivery conduit of liquid from the pump and is preferably hollowed out by a capillary groove to channel the flow of liquid leaving the delivery conduit of the pump to the distributor element.

The wetting device may also comprise a channel connecting the reservoir with the rod of the brush, at least a portion of which encloses a porous material making it possible to distribute the liquid originating in the reservoir by capillary action to the distributor element. The channel may comprise a tube filled with porous material, or may be made entirely of porous material. This channel is fixed at one of its ends to the reservoir and at its other end to the rod of the distributor element; at it end fixed to the rod of the distributor element, it may be provided with a tip of porous material having a porosity greater than that of the porous material of the channel, such that droplets can form on the end of the tip and drop onto the distributor element. The channel may also be provided with an opening at its end connected to the rod of the distributor element for distributing the liquid onto the distributor element. In that case, the reservoir is preferably made at least partly of a flexible material, in particular a flexible plastic material, with a portion of the wall of flexible material being accessible from the outside in such a way that by pressing on this portion of the wall, the user can expel the liquid from the reservoir. Preferably, the cap is open at its end remote from the tubular body when it si joined to it in the closed position of the applicator, and one end of the reservoir projects outside the cap. This end projecting outside the cap is more particularly made in the form of a bellows.

Advantageously, the reservoir is installed in such a way that it can be easily replaced. The reservoir used as refills are closed at one end by a lid that can be pierced when the reservoir is joined to the wetting device, that is, to either the aspiration conduit of the pump or the channel of porous material. To this end, the free edge of the conduit or channel is a cutting edge, for example.

The cake of mascara is contained in the tubular body of the applicator. Preferably, it is contained in a cup installed inside the tubular body. The cup is preferably installed translatably inside the tubular body. The shape of the outer wall of the cup may correspond in cross section to the shape of the inside wall of the tubular body of the applicator. Advantageously, it may also be provided with fins that cooperate with the grooves of the tubular body, to prevent it from twisting inside the tubular body. Preferably, a device is capable of displacing the cup toward the free opening of the tubular body; this device may be a pushbotton manually controlled from outside, through the botttom of the tubular body, for example. It may also be a spring disposed between the bottom of the tubular body and the bottom of the cup, such as a helical spring, particulary one of molded plastic; such a spring is advantageously joined to a lid that by being screwed in or telescoped closes the bottom of the tubular body; in this case, the cup, the spring and the lid preferably form a molded one-piece set. The cake of mascara may also easily be changed by introducing a refill set, comprising the lid, the spring and the cup containing the cake of mascara, into the tubular body.

In the first embodiment mentioned above, the cavity in the cake of mascara preferably has a shape on the order of a cone, and the length of this cavity is less than that of the cake of mascara. The applicators of the first embodiment of the invention function as follows: with the applicator closed, the user actuates the device for wetting the distributor element from outside. Once the distributor element is moist, the user opens the applicator. By the action of the spring or pushbutton, the cake and its cup move upward. The user can then make a mixture by twisting the distributor element in the cavity of the mascara cake. The user can stop as soon as the distributor element has picked up the desired amount of mascara. If the user wishes, the user can also optionally remoisten the distributor element. When the user is finished, the user closes the applicator; the distributor element is accommodated in the cavity of the mascara cake and pushes the spring or pushbutton back again.

In the second embodiment mentioned above, the reservoir and the cake of mascara are disposed in the tubular body of the applicator, with the reservoir disposed in such a way that the brush plunges into the reservoir when the applicator is closed.

In a first variant of the second embodiment, the reservoir may be disposed in the vicinity of the bottom of the tubular body, and the cake of mascara may be disposed in the vicinity of the attachment of the cap to the tubular body, with the cake of mascara hollowed out over its entire length. In this case, the cavity in the cake of mascara preferably has a cylindrical shape. The tubular body of the applicator is then made of two separable parts.

In a second variant of the second embodiment, the cake of mascara can be disposed at the bottom of the tubular body; the bottom of the tubular body is then provided with an opening, and the reservoir is disposed in the vicinity of the device for attaching the cap to the tubular body. In that case, the cake of mascara is preferably in a cup provided with a lid and installed in such a way that the lid is disposed outside the tubular body, and the cavity in the cake is preferably conical.

In the case of these two variants, the reservoir is preferably provided with squeegee lips on the side where the distributor element enters and exits.

The applicator sets according to this second embodiment function as follows: In the closed position, the distributor element dips into the reservoir. The user opens the applicator and removes the distributor element; the distributor element is squeegeed with the aid of the squeegee lips at the outlet from the reservoir. When the cake of mascara is located at the outlet from the tubular body, the user fills the brush by a rotational and/or reciprocating movement inside the cake of mascara. If the cake of mascara is located at the bottom of the tubular body, the user opens the lid forming the bottom of the tubular body and fills the brush by twisting it in the cavity of the cake. Optionally, the user may remoisten the brush, if the user thinks it useful. Once the user believes that the distributor element is suitably full of mascara, the user proceeds to effect a make up. Once the user has finished, the user re-closes the applicator set, and the distributor element dips back into the reservoir again.

The invention will be better understood from the ensuring detailed description of several exemplary embodiments of the invention, which are purely illustrative, taken in conjunction with the drawings.

DETAILED DESCRIPTION

Figure 1:
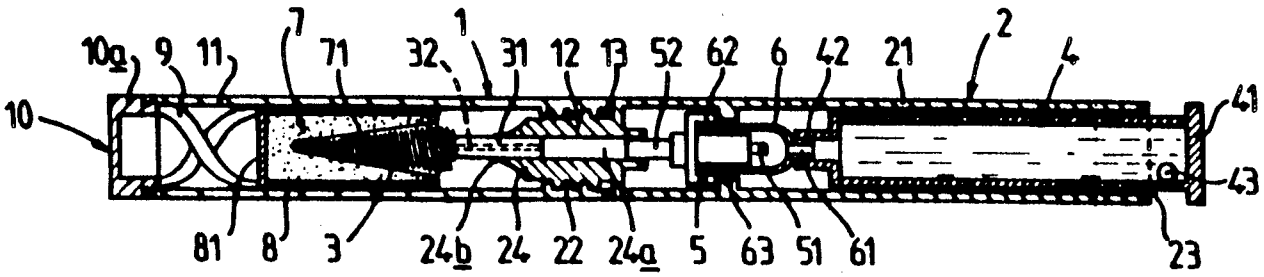
FIG. 1 is a longitudinal section showing a first version of the first embodiment of the invention including a pump.

In its closed position, the applicator set shown in FIG. 1 has an elongated cylindrical form. It includes, first, a cap 2, which contains a reservoir 4, a pump 5, and an intermediate air recovery part 6 and carries a brush 3 at the end of a rod 31, and second, a tubular body 1 containing a cake of mascara 7, accommodated in a cup 8 on which a spring 9 presses. When the applicator set is closed, the brush 3 is at least partially inside the cake of mascara 7.

The tubular cylindrical body 1 is closed at one end by a separate lid 10; it is defined by a side wall 11 and includes a free opening 13 at its end opposite the lid, or bottom, 10. In the vicinity of its opening 13 the side wall 11 is provided with an internal screw thread 12. The applicator set also includes a cylindrical cap 2 defined by a cylindrical side wall 21. This cylindrical cap is provided with an external screw thread 22 at one of its ends and includes an opening 23 at its other end. Inserted into the cap 2 is a reservoir 4 of rigid material having a cross section slightly smaller than that of the cap 2, such that it can be moved in translation inside the cap 2. The reservoir 4 projects partway outside the cap 2 via the opening 23, and at the end located outside the cap 2 is provided with a reinforcement 41, dimensioned in cross section such that it can be supported on the edge of the opening 23. At the end opposite the end projecting outside the cap 2, the reservoir 4 includes a tubular constriction which is fitted with force over the tubular constriction 61 of an intermediate air recovery part 6 in the pump 5. The intermediate air recovery part 6 is disposed like a bell outside and on top of the pump 5, and in its portion most remote from the tubular constriction 61, between its wall and that of the pump 5, forms an annular space 62 for the recovery of air from the pump 5. The intermediate part 6 is guided in the cap 2 by an annular shoulder 63 in which it can slide. The intermediate part 6 and consequently the reservoir 4 are joined to the piston of the pump 5. The pump 5 is a microdispensing pump; the aspiration conduit 51 of the pump 5 opens in the intermediate part 6 toward the tubular constriction 61 of the intermediate part 6. The delivery conduit 52 of the pump discharges in a longitudinal chamber 24*a* made in the fixation 24 of the brush 3. The side wall of the fixation 24 is substantially within the extension of that of the cap 2; at its end opposite of the delivery conduit 52, there is included an opening 24*b* in which the rod 31 of the brush 3 is inserted with force; it has an external screw thread 22 complementary to the screw thread 12 of the tubular body 1. The rod 31 of the brush 3 is provided with a capillary groove 32. The brush 3 is a conical brush with capillary bristles.

The cake of mascara 7 shown in FIG. 1 has the external shape of a cylinder of revolution, and it is hollowed out over a portion of its length by an axial cavity 71 having a generally conical shape. The cake of mascara 7 is contained in a cup 8 including a cylindrical side wall the cross section of which is slightly smaller than that of the side wall 11 of the tubular body 1, so that it can slide longitudinally in this tubular body 1. The cup 8 includes a bottom 81 perpendicular to the axis of the tubular body 1. The bottom 81 is joined to a helical spring 9, which in turn is joined to the lid 10 comprising the bottom of the tubular body 1. The cup 8, the helical spring 9 and the lid 10 are of plastic material and are a single molded part. The lid 10 is locked onto the side wall 11 of the tubular body 1 with a flange 10*a*. The subassembly (cup 8, cake of mascara 7, spring 9 and lid 10) can be removed from the tubular body 1 once the mascara is used up and replaced by another identical subassembly comprising a refill.

The applicator set shown in FIG. 1 functions as described below. When the applicator set is closed, the user presses once or twice on the reinforcement 41 of the reservoir 4 that projects outside the cap 2. The pressure is transmitted to the pump 5 via the intermediate part 6. Liquid is aspirated in the reservoir 4 via the aspiration conduit 51 of the pump and delivered via the conduit 52 to the chamber 24*a*. The liquid circulates by capillary action along the rod 31 of the brush 3 via the capillary groove 32 and moistens the brush 3. Once the brush is moistened, the user unscrews the cap 2. By the action of the spring 9, the cup 8 and consequently the cake of mascara 7 are pushed toward the opening 13 of the tubular body 1. The user then rubs the brush 3 inside the cavity 71 of the cake of mascara 7 until the user has picked up the desired amount of mascara to make up the eyelashes. Once the user is finished, the user screws the cap 2 back on. The brush 3 pushes the cup 8 containing the cake of mascara back in, which compresses the spring 9; the brush holds the cup 8 in place when the applicator set is closed.

If the user wishes to change the cake of mascara 7, either because it is used up or because the user wishes to change the color, the user pulls out the subassembly (cup 8, spring 9, lid 10) from the applicator set by acting on the flange 10*a* of the lid 10 and replaces it with another set.

When the reservoir 4 is empty, the user can replace it by pulling on it, via the reinforcement 41, to disengage it from the tubular constriction 61 on which it is fitted by force via its tubular constriction 42. The user takes a refill reservoir, the tubular constriction 42 of which is closed with a lid, and wedges the tubular constriction 42 onto the constriction 61 of the intermediate part of which the edge is a cutting edge; the lid is then broached at the moment the reservoir is put in place. It should be noted that the reservoir 4 may contain at least one bead 43 to agitate the liquid that it contains.

Figure 2:
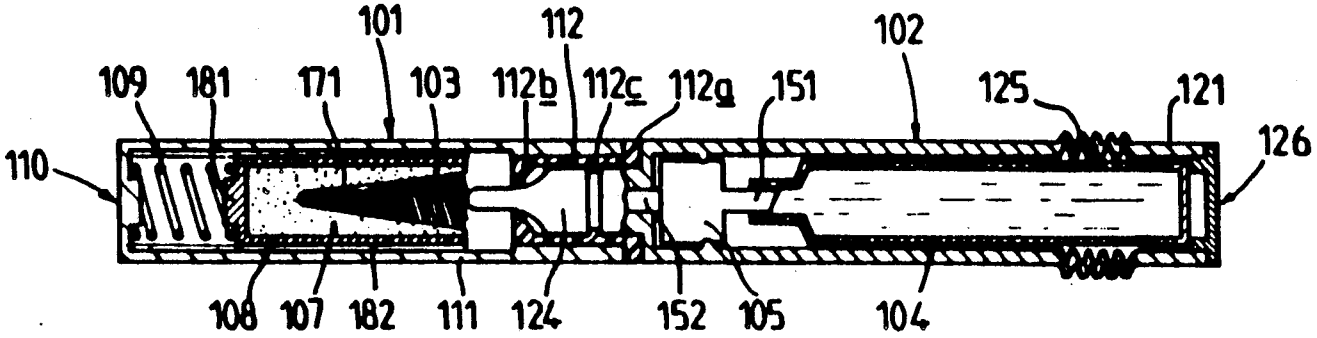
FIG. 2 is a longitudinal section showing a second version of the first embodiment of the invention including a pump.

FIG. 2 is a longitudinal section showing a second version of the applicator set of the first exemplary embodiment of the invention. This applicator includes a tubular body 101 and a cap 102. The tubular body 101 includes a bottom 110 and a cylindrical side wall 111; it contains a cylindrical cake of mascara 107 having a conical cavity 171 on the inside. The cake of mascara 107 is installed in a cup 108 that includes a bottom 181 and is provided on its side wall with radial fins 182 that cooperate with corresponding grooves of the tubular body 101. The bottom 181 of the cup rests against a metal helical spring 109, which in turn rests against the bottom 110 of the tubular body 101. The cap 102 includes a separate bottom 126 and a side wall 121 of flexible plastic material, in which an accordion-folded bellows 125 is formed. The bottom 126 of the cap 102 is a flanged lid fixed by being snapped into place on the side wall 121 of the cap 102. The brush 103 is fixed by its rod (not shown) to the fixation 124 of the cap 102. The cap 102 contains a liquid reservoir 104 of rigid material and a pump 105; the flange of the lid 126 rests on the bottom of the reservoir 104. The aspiration conduit 151 of the pump 105 is connected to the reservoir 104, and the delivery conduit 152 of the pump opens into a chamber (not shown) in the fixation 124. The fixation 124 is held within the tubular body 101 with the interposition of a cylindrical retaining ring 112. This ring 112 is joined to the tubular body 101; at one of its edges, it is provided with an annular collar 112*a* that is supported on the end of the side wall of the tubular body closest to the cap 102 when the applicator set is closed. Opposite the collar 112*a*, the ring 112 includes an annular shoulder 112*b* oriented toward the interior of the tubular body 101, which serves both as a squeegee for the brush 103 and as a stop for the cup 108. This ring also includes an internal annular bulge 112*c* nesting in a corresponding circular groove of the fixation 124.

The applicator shown in FIG. 2 functions as follows: The user presses on the lid 126 of the cap and which then pushes on the reservoir 104; the bellows 125 compresses, which enables the translation of the liquid reservoir 104 in the cap 102. As described for FIG. 1, the reservoir 104 actuates the pump 105, and the liquid leaving the reservoir 104 moistens the brush 103. The user then pulls on the cap 102 to remove the tubular body 101, after the disengagement of the annular bulge 112*c* from its associated groove of the fixation 124. The brush leaves the cavity 171 of the cake of mascara and passes through the annular shoulder 112*b* of the ring 112, where it is sequeegeed. The cup 108 which was held in place by the brush 103 is pushed by the spring 109 until it comes to a stop against the bulge 112*b* of the ring 112. The user then rubs the brush 103 on the mascara by twisting it inside the cavity 171 of the cake of mascara and fills the brush with mascara. The fins 182 of the cup 108 prevent the cup from twisting during this operation. Once the user has put the desired amount of mascara on the brush 103, the user proceeds to make up the eyelashes. Once the user is finished, the user closes the applicator set; the brush 103 is reintroduced into the cavity 171 and pushes the cup 108 back, compressing the spring 109.

Figure 3:
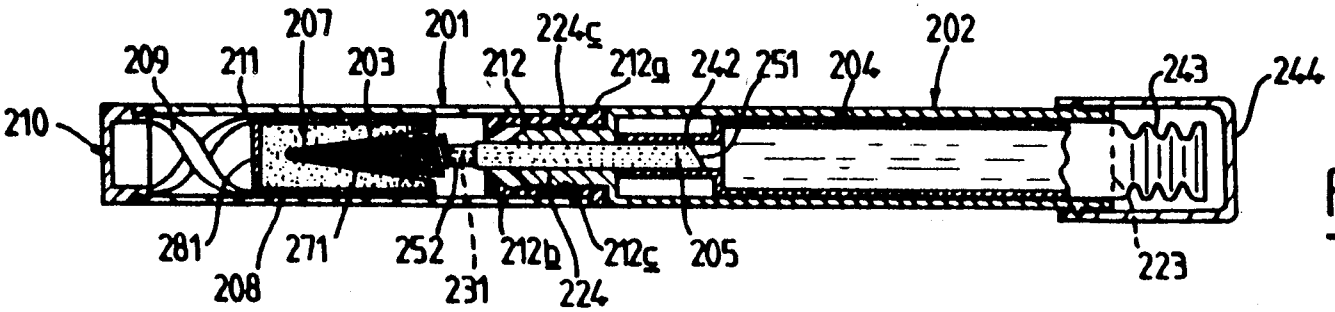
FIG. 3 is a longitudinal section showing a third version of the first embodiment of the invention a channel of porous material.
Figure 4:
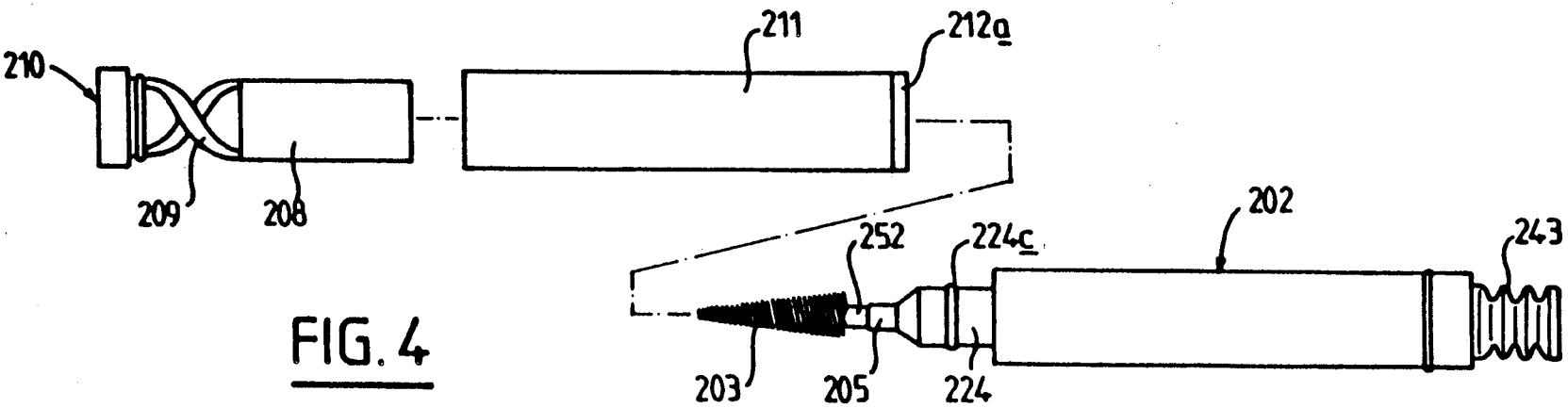
FIG. 4, in a front exploded view, shows the applicator of FIG. 3.

FIGS. 3 and 4 show a third version of an applicator set according to the first exemplary embodiment of the invention, in which the device for distributing the liquid compresses a channel 205, at least a portion of which comprises a porous material. The applicator shown in FIG. 3 comprising a tubular body 201 and a cap 202.

The tubular body 201 has side walls 211, and its bottom is closed by a snap-locked lid 210. It contains a cake of mascara 207 provided with a conical cavity 271; the cake of mascara 207 is in turn contained in a cup 208, which as described in the case of FIG. 1 forms a set obtained by molding with a helical spring 209 and the lid 210. At its end opposite this tubular body 201, the cap 202 has an opening 223; at its other end, it is provided with a fixation 224, on the outside of which in provided an annular detent bulge 224*c* corresponding to an annular detent groove 212*c* of the above-described retaining ring 212. The reservoir 204 is made of a flexible material, and one of its ends projects through the opening 223 to outside the cap 202. The projecting portion 243 has the form of a bellows and is protected with a removable cap 244. The channel 205 is a ring of rigid porous material. One end 251 of this ring is beveled; the other end has a tip 252 of porous material, the porosity of which is higher than that of the material comprising the ring; the rod 231 of the brush 203 is wedged with force into this tip. The length of the rod 231 that is left free between the tip 252 and the brush 203 is slight, or even nil. The channel 205 is wedged with force into a constricted tubular portion 242 of the reservoir 204. The tubular body 201 nests on the fixation 224 of the cap 202 with the interposition of a retaining ring 212. This ring 212 is joined to the tubular body 201; it is provided on one of its edges with an annular collar 212*a*, which is supported on the edge of the side wall 211 of the tubular body; at its opposite end, it includes an annular shoulder 212*b* oriented toward the inside the tubular body 201, which serves both as a squeegee lip for the brush 203 and as a stop for the cup 208.

The applicator set of FIG. 3 functions as follows. When the applicator is closed, the pressure exerted by the brush 203 in the cavity 271 of the cake of mascara 207 holds the cup 208 in place. To moisten the brush, the user removes the cap 244 that protects the bellows 243 during transport, and presses on this bellows 243. The liquid contained in the reservoir 204 is then pushed into the porous channel 205, where it circulates by capillary action, and then into the porous tip 252. Droplets form at the end of this porous tip, then drop onto the brush 203 and moisten it. The user then disengages the cap 202 from the tubular body 201. The cup 208 is pushed by the spring 209 until it comes to a stop against the annular shoulder **212*b* of the retaining ring 212. The user can then rub the brush 203 against the cake of mascara 207 by twisting it in the conical cavity 271. The brush 203 is an oval brush, one dimension of which in each cross section is greater than that of the conical cavity 271. Thus when it is wedged to the bottom in the conical cavity 271 and the user twists it, it fills up readily with mascara. The user can remoisten the brush if necessary by pressing on the bellows 243 again. The user then closes the applicator again. The brush 203 is re-inserted into the cavity 271 of the cake of mascara, which presses the cup 208 back again and compresses the spring 209. Finally, the user replaces the cap 244 to protect the bellows 243 when the set is being carried about. The set, molded from a single piece including the lid 210, the helical spring 209 and the cup 208 in which the cake of mascara 207 has been introduced, can be changed, if the cake of mascara contained in the cup 208 has been used or the user wishes to change the color of mascara. The reservoir 204 can also be changed, for example when it is empty. At the end having its tubular constriction 242, the refill reservoir is initially closed by a lid, which is broken when it is wedged with force onto the beveled end 251 of the channel 205**.

Figure 5:
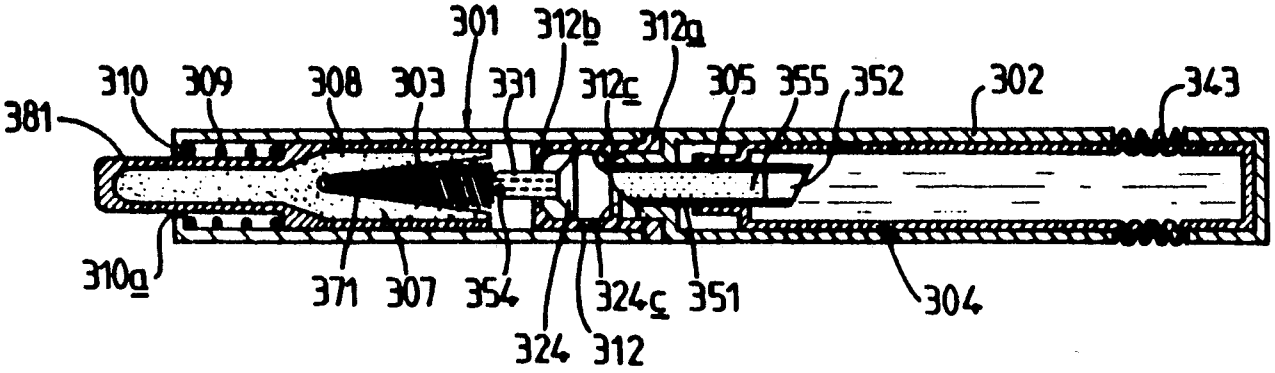
FIG. 5 shows a fourth version of the first embodiment of the invention, again including a channel of porous material.

FIG. 5 shows a fourth version of the first embodiment of the invention. In this version, the device for wetting the brush includes a channel 305 formed by a tube 351 filled with a porous substance 355. The applicator set includes on the one hand a tubular body 301 containing the cake of mascara 307, which in turn is contained in a cup 308, and on the other hand a cap 302 containing a reservoir 304 provided with a bellows 343. The cap 302 is extended at one end by a fixation 324 that carries a brush 303. The tubular body 301 is nested on the fixation 324, where an annular groove **324*c* has been made, with an interposed retaining ring 312 including an annular snap-lock bulge 312*c* and an annular shoulder 312*b* forming a squeegee lip and stop for the cup 308. The tube 351 is wedged via one of its open ends 352 into the reservoir 304. Its other end is provided with a small opening 354 for the passage of the liquid and includes a seat for the placement of the rod 331 of the brush 303. A conical cavity 371 is made in the cake of mascara 307. The cup 308 includes a tang 381, which projects outside the tubular body through the bottom 310 of the tubular body 301 via a circular opening 310*a* and serves as a pushbutton. A helical restoring spring 309 is disposed between an external annular protrusion of the cup and the bottom 310** of the tubular body.

The function of the applicator set of FIG. 5 is as follows. When the user presses on the bellows 343 of the cartridge 304, the liquid contained in the reservoir 304 is pushed through the porous substance 355 and emerges via the opening 354 so that it falls drop by drop onto the brush 303. After having disengaged the cap 302 from the tubular body 301, the user pushes the tang 381 of the cup 308 toward the ring 312; this displacement can continue until the moment when the cup 308 comes to a stop against the shoulder **312*b*. The user holds the cup 308 in place and twists the brush in the cavity 371 of the cake until the user thinks the brush is full enough of mascara. The user then stops pressing on the tang 381 acting as a pushbutton. After completing the makeup operation, the user closes the applicator by nesting the cap 302 in the tubular body 301; the cake of mascara is kept pressed against the brush by the spring 309**.

Figure 6:
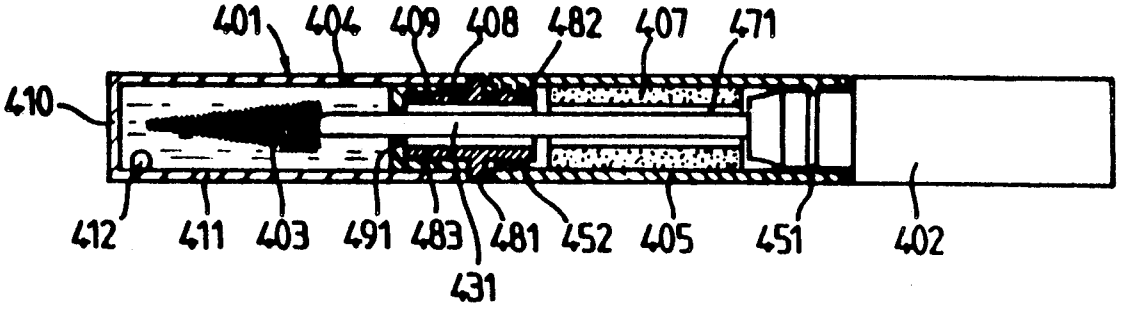
FIG. 6 is a longitudinal section showing a first version of the second embodiment of the invention.

FIG. 6 shows a first version of an applicator according to the second exemplary embodiment of the invention. The applicator shown includes on the one hand a cap 402 carrying a brush 403 at the end of a rod 431, and on the other hand a tubular body 401. The tubular body comprises two cylindrical portions having the same outside diameter: first, a reservoir part 404, closed at one end 410 and defined by a side wall 411, which contains the liquid used to moisten the brush and also contains a bead 412; second, a preferably transparent tubular portion 405, containing a cake of mascara 407 in the form of a cylindrical ring surrounding a cylindrical axial cavity 471. In cross section, the cake of mascara has an outside diameter slightly less than the inside diameter of the tubular portion 405, and it is fixed to the inside wall of the tubular portion 405, for instance by gluing. The cap 402 is fixed with the aid of a snap-lock device 451 onto this tubular portion 405. On the opposite end from the snap-lock device 451, the tubular portion 405 has an internal screw thread 452. The tubular portions 404 and 405 are fixed to one another with the aid of a system including a ring 408 and a seal 409 made of an elastomeric substance. The ring 408 is a cylindrical ring; it includes an external screw thread 482 at one end corresponding to the internal screw thread 452 of the tubular portion 405. An outer annular shoulder 481 is located behind the screw thread and has an outside diameter equal to the outside diameter of the tubular portion 405 at the level of the internal screw thread 452. At the opposite end 483 from the thread 452, the outside wall of the ring 408 is cylindrical. The annular sealing ring 409 is disposed between the side wall 411 of the reservoir 404 and the cylindrical end 483 of the ring 408; at its end located toward the reservoir 404, this seal has an annular squeegee lip 491 perpendicular to the wall 411 of the reservoir.

The applicator set of FIG. 6 functions as follows: The user opens the applicator by disengaging the locking device 451 from the tubular portion 405 containing the cake of mascara 407. The user removes the brush 403 that is at the end of the rod 431. In its exiting movement, the brush 403 passes through the annular squeegee lip 491; the surplus liquid picked up by the brush is thus removed. Then the brush passes through the ring 408 and comes to the level of the cake of mascara 407, which is in the form of a hollow cylinder. By a back-and forth and optionally twisting motion, the user fills the brush with mascara as desired. When the desired amount has been obtained, the user makes up the eyelashes. The user then closes the applicator set, and the brush 403 plunges back into the portion forming the reservoir 404.

If the user wishes to change the cake of mascara 407, either because it is used up or because the user wishes to use a cake of a different color, the user unscrews the tubular portion 405 from the ring 408 and disengages the locking device 451 from the cap 402; the user inserts a refill comprising a tubular portion 405 containing a cake of mascara 407 by screwing it onto the ring 406 and then reattaching the cap.

Figure 7:
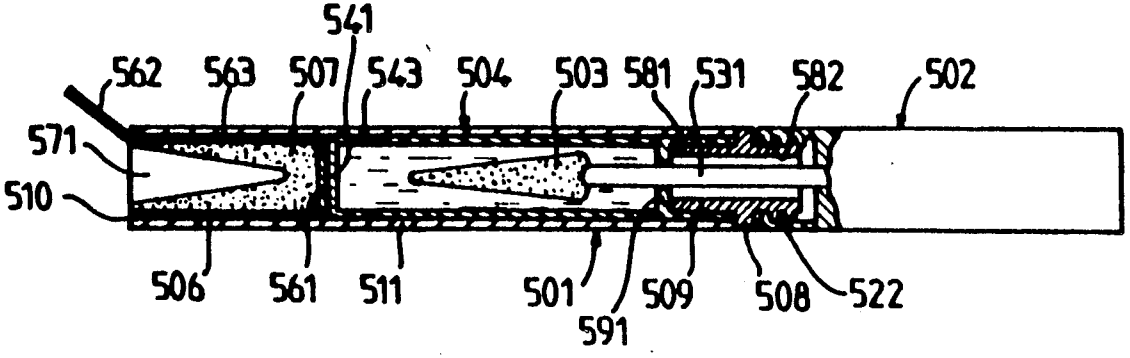
FIG. 7 is a longitudinal section showing a second version of the second embodiment of the invention.
Figure 8:
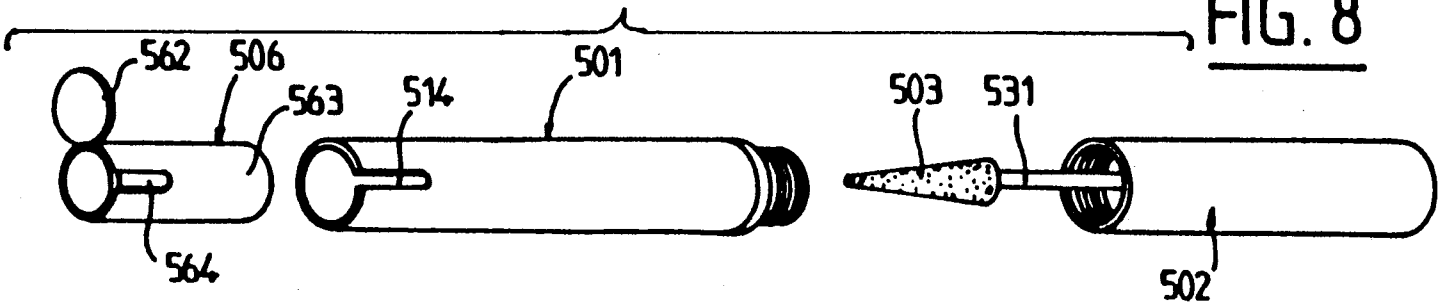
FIG. 8 is a perspective exploded view of the device of FIG. 7.

FIGS. 7 and 8 show a second version of an applicator set of the second exemplary embodiment of the invention. The applicator set shown includes a cap 502, onto which a rod 531 is wedged by force; the rod carries a distributor element 503 comprising a flexible cone, known as a "pen", of elastic flock material, or in other words on which textile fibers have been deposited, for instance with glue. The applicator set also includes a tubular body 501 having a cylindrical side wall 511. The tubular body 501 contains a reservoir 504 and a cup 506 containing a cake of mascara 507; the tubular body 501 is open on both ends. The reservoir 504 includes a bottom 541 and a cylindrical side wall 543, having dimensions in cross section that are slightly smaller than those of the tubular body 501, so that it can be introduced into it; it is open at its end located toward the cap when the applicator is in the closed position. The reservoir 504 is held by a system comprising a ring 508 and an elastic seal 509 identical to those described in the case of the applicator of FIG. 6; the ring 508 includes an external thread 582 at one end which corresponds to a screw thread 522 of the cap 502; the other end has the form of a smooth cylinder 581. The annular seal 509 of elastic material is disposed around this smooth cylindrical portion 581, and at its end located near the reservoir 504 this seal includes an annular squeegee lip 591 perpendicular to the wall 511 of the reservoir. The bottom of the tubular body 501, on the end opposite the cap when the applicator is in the closed position, has an opening 510. Via this opening, a cup 506 is introduced, containing the cake of mascara 507. The cup 506 includes a bottom 561 located in the vicinity of the bottom 543 of the reservoir 504 and a lid 562 affixed to the cup via a film hinge. The side wall 563 of the cup is provided with a boss 564, which corresponds to a window 514 in the side wall 511 of the tubular body 501. The cake of mascara 507 is pierced with a conical cavity 571, the point of which is located in the vicinity of the bottom of the cup.

The applicator set according to the present application functions as described below.

The user unscrews the applicator and removes the "pen" 503. Along its way, the "pen" is squeegeed by the lip 591, which removes the surplus liquid. The user opens the lid 562 of the cup 506 and rubs the "pen" 503 by twisting it in the conical hole 571 of the cake of mascara 507, until the desired amount of mascara has been deposited on the brush 503. If necessary, the user can dip the "pen" 503 into the reservoir 504 again. The combined action of the boss 564 and the window 514 of the sidewall 511 prevents twisting of the cup 506 in the tubular body 501 during the operation of filling the "pen" 503. Once the makeup operation is completed, the user re-closes the applicator by screwing the cap 502 onto the tubular body 501; the "pen" 503 dips into the reservoir 504 again. The user closes the lid 562 as well.

When the user wishes to change the cake of mascara 507, either because it is used up or because the user wishes to change the color, the user removes the cup 506 containing the cake of mascara 507, along with its lid 562, by disengaging the boss 564 from the window 514 of the side wall 511. Then the user introduces an identical refill.

It will be understood that the embodiments described above may be modified in any desired manner without departing from the scope of the invention.

What is claimed is:

1. A cosmetic applicator set including a cake of cosmetic and a distributor element, the set being in the form of a fountain pen and including two portions, one portion being a tubular body and the other portion being a cap that is removably attachable to said tubular body, said tubular body including said cake of cosmetic and said cap carrying said distributor element so as to extend therefrom, said tubular body including a reservoir for a moistening agent, said reservoir being disposed in said tubular body at one end thereof so that, when said cap is attached to said tubular body at the opposite end thereof, said distributor element is plunged into said reservoir, said tubular body having adjacent said opposite end said cake of cosmetic in the form of an annular body disposed so that when said distributor element is withdrawn from said reservoir, said distributor element will engage said annular body and take up the cosmetic product, said tubular body having wiping means disposed between said reservoir and said annular body for wiping said distributor element, said opposite end having a device for joining said cap to said tubular body.

2. An applicator set as defined by claim 1, characterized in that the cake of mascara (7, 107, 207, 307, 407, 507) includes in addition to wax and colorants, microcapsules the walls of which are resistant to the pouring temperature of the mascara and protect the cosmetically active agents.

3. An applicator set as defined by claim 1, characterized in that the liquid serving to moisten the distributor element is water.

4. An applicator set as defined by claim 1, characterized in that the reservoir (404) is disposed in the vicinity of the bottom of the tubular body (401), and the cake of mascara (407) is disposed in the vicinity of the device joining the cap (402) to the tubular body, the cake of mascara (407) being hollowed out cylindrically over its entire length.

5. An applicator set as defined by claim 4, characterized in that the tubular body of the applicator is formed of two separable parts (404, 405).

6. An applicator set as defined in claim 1, wherein the liquid serving to moisten the distributor element is physiological serum mixed with at least one cosmetically active agent.

7. An applicator set as defined by claim 6, characterized in that the cosmetically active agent is a gelatinizing agent.

8. An applicator set as defined by claim 1, characterized in that the reservoir (404) is provided with squeegee lips (491).

* * * * *